US011536009B2

(12) United States Patent
Lehmann et al.

(10) Patent No.: US 11,536,009 B2
(45) Date of Patent: Dec. 27, 2022

(54) SYSTEM FOR DETECTING LOCKING PIN ENGAGEMENT OF AN IMPLEMENT

(71) Applicant: Deere & Company, Moline, IL (US)

(72) Inventors: Doug M. Lehmann, Centralia, IA (US); Aaron R. Kenkel, East Dubuque, IL (US)

(73) Assignee: DEERE & COMPANY, Moline, IL (US)

( * ) Notice: Subject to any disclaimer, the term of this patent is extended or adjusted under 35 U.S.C. 154(b) by 754 days.

(21) Appl. No.: 16/523,275

(22) Filed: Jul. 26, 2019

(65) Prior Publication Data

US 2021/0025144 A1 Jan. 28, 2021

(51) Int. Cl.

| | |
|---|---|
| ***E02F 9/26*** | (2006.01) |
| ***E02F 3/36*** | (2006.01) |
| *E02F 9/22* | (2006.01) |

(52) U.S. Cl.

CPC ..... *E02F 9/264* (2013.01); *E02F 3/3609* (2013.01); *E02F 3/3622* (2013.01); *E02F 3/3663* (2013.01); *E02F 9/226* (2013.01)

(58) Field of Classification Search

CPC ... E02F 9/226; E02F 9/26; E02F 9/264; E02F 9/265; E02F 3/3609; E02F 3/3663

See application file for complete search history.

(56) References Cited

U.S. PATENT DOCUMENTS

| | | | |
|---|---|---|---|
| 4,780,046 | A | 10/1988 | Friesen et al. |
| 5,064,339 | A | 11/1991 | Ahlers |
| 5,141,385 | A | 8/1992 | Tibbatts et al. |
| 5,685,689 | A | 11/1997 | Schneider et al. |
| 5,984,618 | A | 11/1999 | Deneve et al. |

(Continued)

FOREIGN PATENT DOCUMENTS

| | | | |
|---|---|---|---|
| DE | 1156023 | B | 10/1963 |
| DE | 1291284 | B | 3/1969 |

(Continued)

OTHER PUBLICATIONS

Extended European Search Report for Application No. EP16190932.0 dated Feb. 23, 2017 (8 pages).

(Continued)

*Primary Examiner* — Gerald McClain
(74) *Attorney, Agent, or Firm* — Michael Best & Friedrich LLP

(57) ABSTRACT

A monitoring system for a work vehicle having a lift system to which an implement is attachable via a connection assembly includes a weight detection subsystem operable with the lift system and configured to transfer signals representative of a weight supported by the lift system. The monitoring system also includes a position detection subsystem operable with the connection assembly and configured to transfer signals representative of a state of the connection assembly. A controller is in operable communication with the weight detection subsystem and the position detection subsystem and is configured to receive signals from the weight detection subsystem and from the position detection subsystem, determine a condition of the connection assembly based on the signals received, and output a signal based at least in part on the determined condition.

11 Claims, 8 Drawing Sheets

(56) References Cited

U.S. PATENT DOCUMENTS

| | | | | |
|---|---|---|---|---|
| 6,301,811 | B1 * | 10/2001 | Gilmore, Jr. | E02F 3/3654 37/468 |
| 6,422,805 | B1 | 7/2002 | Miller | |
| 6,519,923 | B1 * | 2/2003 | Cooksey | A01D 41/16 56/14.9 |
| 7,160,076 | B2 | 1/2007 | Curl et al. | |
| D595,746 | S | 7/2009 | Iida et al. | |
| D610,172 | S | 2/2010 | Yukino et al. | |
| D645,884 | S | 9/2011 | Attwood et al. | |
| D646,303 | S | 10/2011 | Lanting et al. | |
| 8,376,388 | B2 | 2/2013 | Graber et al. | |
| 8,500,386 | B2 | 8/2013 | Griffiths et al. | |
| 8,662,817 | B2 | 3/2014 | Daraie et al. | |
| 8,678,697 | B2 | 3/2014 | Monaghan et al. | |
| 8,857,081 | B2 | 10/2014 | McCormick et al. | |
| 8,974,137 | B2 | 3/2015 | Parker et al. | |
| D812,110 | S | 3/2018 | Hesla | |
| D812,111 | S | 3/2018 | Sivinski | |
| 10,407,879 | B2 | 9/2019 | Gonzalez et al. | |
| D905,765 | S | 12/2020 | Sinn et al. | |
| D908,742 | S | 1/2021 | Ankenman et al. | |
| 2006/0210384 | A1 | 9/2006 | Warren | |
| 2007/0130932 | A1 * | 6/2007 | Fatemi | E02F 3/365 60/459 |
| 2011/0313625 | A1 * | 12/2011 | Miller | E02F 3/3663 701/50 |
| 2014/0308061 | A1 * | 10/2014 | Robi | G01N 3/20 73/849 |
| 2016/0237656 | A1 * | 8/2016 | Doherty | E02F 3/3618 |
| 2017/0089029 | A1 | 3/2017 | Esqueda | |
| 2018/0238015 | A1 * | 8/2018 | Fey | E02F 9/265 |
| 2020/0277756 | A1 * | 9/2020 | Hou | G06K 9/6288 |
| 2021/0010242 | A1 | 1/2021 | Kollmann | |
| 2021/0123211 | A1 * | 4/2021 | Miller | E02F 9/226 |

FOREIGN PATENT DOCUMENTS

| | | | |
|---|---|---|---|
| DE | 10138974 | A1 | 4/2002 |
| EP | 2843378 | A1 | 3/2015 |
| EP | 3266940 | A1 | 1/2018 |
| GB | 1474862 | A | 5/1977 |
| GB | 1475202 | A | 6/1977 |
| JP | H11193545 | A | 7/1999 |
| WO | 0177447 | A1 | 10/2001 |
| WO | 2004005180 | A1 | 1/2004 |

OTHER PUBLICATIONS

Glassmaster Controls, "Cable Latch Systems," brochure <http://www.gcontrols.com/products/cable_latches_latch_products/Cable_Latch_Systems_Glassmaster_Controls.pdf>, Dec. 22, 2004 (4 pages).

* cited by examiner

SYSTEM FOR DETECTING LOCKING PIN ENGAGEMENT OF AN IMPLEMENT

BACKGROUND

The present disclosure relates to a monitoring system configured to provide indication to an operator of the coupling state of an implement to a movable arm of a work vehicle.

SUMMARY

In one aspect, the disclosure is directed to a work vehicle including a frame, a lift system including a movable arm secured to the frame, a coupler connected to the movable arm, operable via a hydraulic cylinder, and attachable to a work implement, a first sensor operatively coupled to a portion of the lift system and configured to send a signal representative of a change in pressure of hydraulic fluid associated with the movable arm, and a second sensor operatively coupled to the coupler and configured to send a signal representative of a change in state of the coupler. A monitoring system includes a controller configured to receive signals from the first sensor and from the second sensor, determine whether the lift system has changed from a state in which no work implement is supported thereby to a state in which all or a portion of a work implement is supported thereby, and determine whether the lift system has changed from a state in which all or a portion of a work implement is supported thereby to a state in which no work implement is supported thereby. The controller is also configured to output a signal to an operator of the work vehicle if 1) the coupler has changed from a first state of attachment to a work implement to a second state of attachment to a work implement and 2) the lift system has changed from a state in which no work implement is supported thereby to a state in which all or a portion of a work implement is supported thereby.

In one aspect, the disclosure is directed to a monitoring system for a work vehicle in which the work vehicle has a lift system to which an implement is attachable via a connection assembly. The monitoring system includes a weight detection subsystem operable with the lift system and configured to transfer signals representative of a weight supported by the lift system. The monitoring system also includes a position detection subsystem operable with the connection assembly and configured to transfer signals representative of a state of the connection assembly. A controller is in operable communication with the weight detection subsystem and the position detection subsystem and is configured to receive signals from the weight detection subsystem and from the position detection subsystem, determine a condition of the connection assembly based on the signals received, and output a signal based at least in part on the determined condition.

In one aspect, the disclosure is directed to a non-transitory computer readable medium comprising program instructions for permitting a controller to monitor a work vehicle through stages of attachment of a work implement thereto, in which the work vehicle has a lift system to which an implement is attachable via a connection assembly. The program instructions when executed cause a processor of the controller to receive signals from a weight detection subsystem operable with the lift system, the signals representative of a weight supported by the lift system. The program instructions also cause the processor to receive signals from a position detection subsystem operable with the connection assembly, the signals representative of a state of the connection assembly. The program instructions further cause the processor to determine a condition of the connection assembly based on the signals received, determine whether the lift system has changed from a state in which no work implement is supported thereby to a state in which all or a portion of a work implement is supported thereby, and determine whether the lift system has changed from a state in which all or a portion of a work implement is supported thereby to a state in which no work implement is supported thereby. The programs instructions also cause the processor to output a signal based at least in part on two or more of the determinations.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
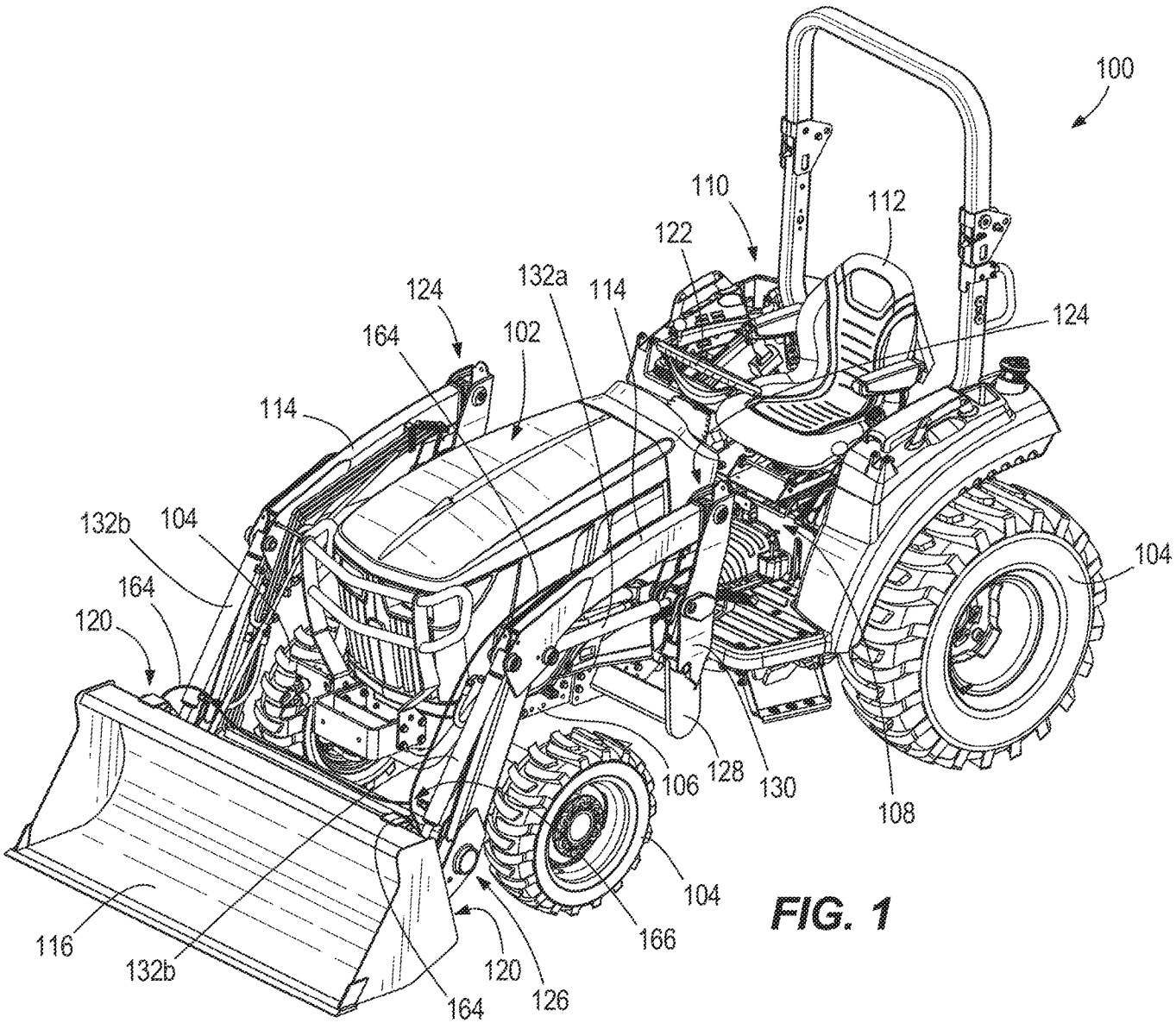
FIG. 1 is a front perspective view of a work vehicle with an implement in the form of a bucket attached thereto via a connection system according to an embodiment of the disclosure.
Figure 2:
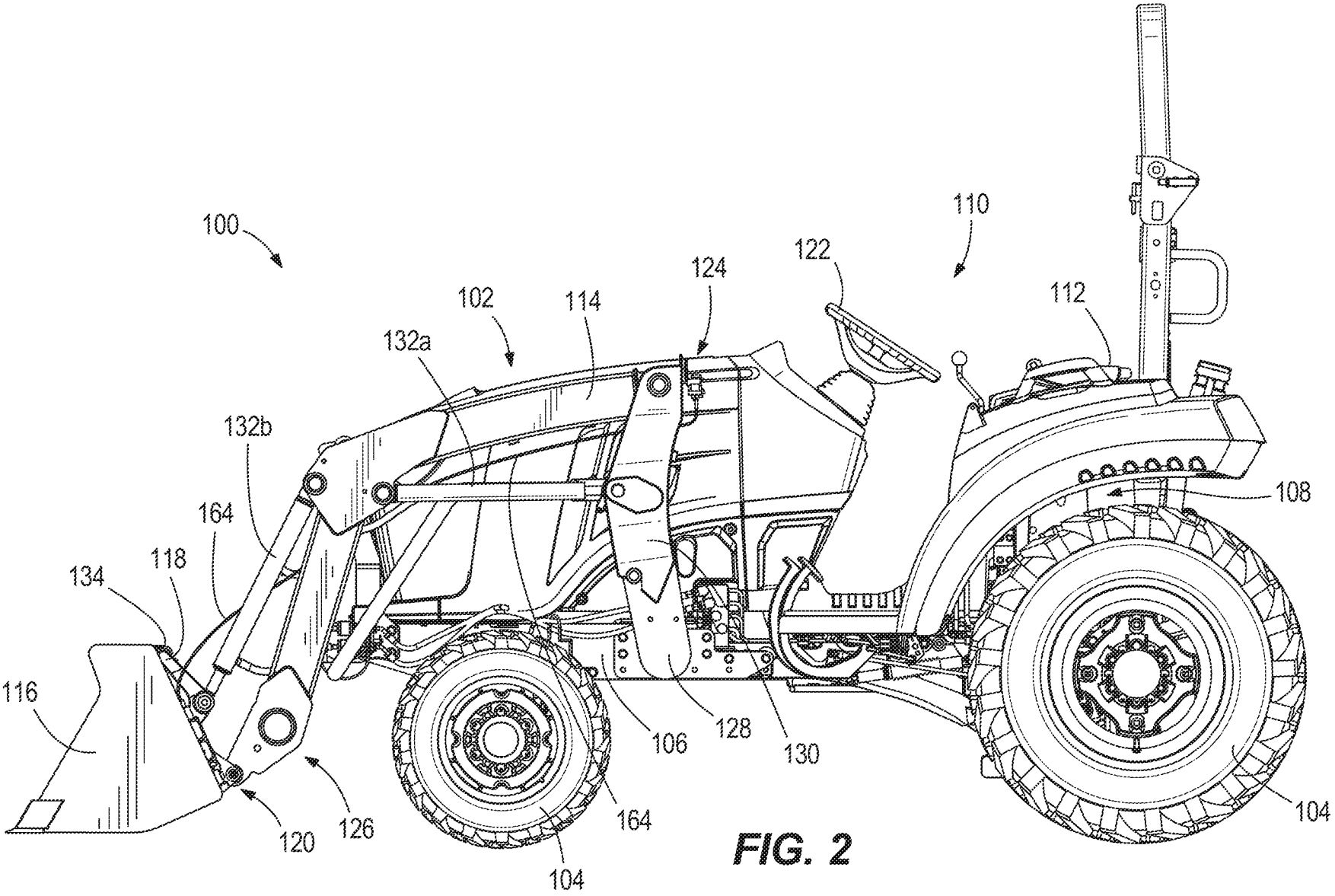
FIG. 2 is a side elevation view of the work vehicle, implement, and connection system of FIG. 1.
Figure 3:
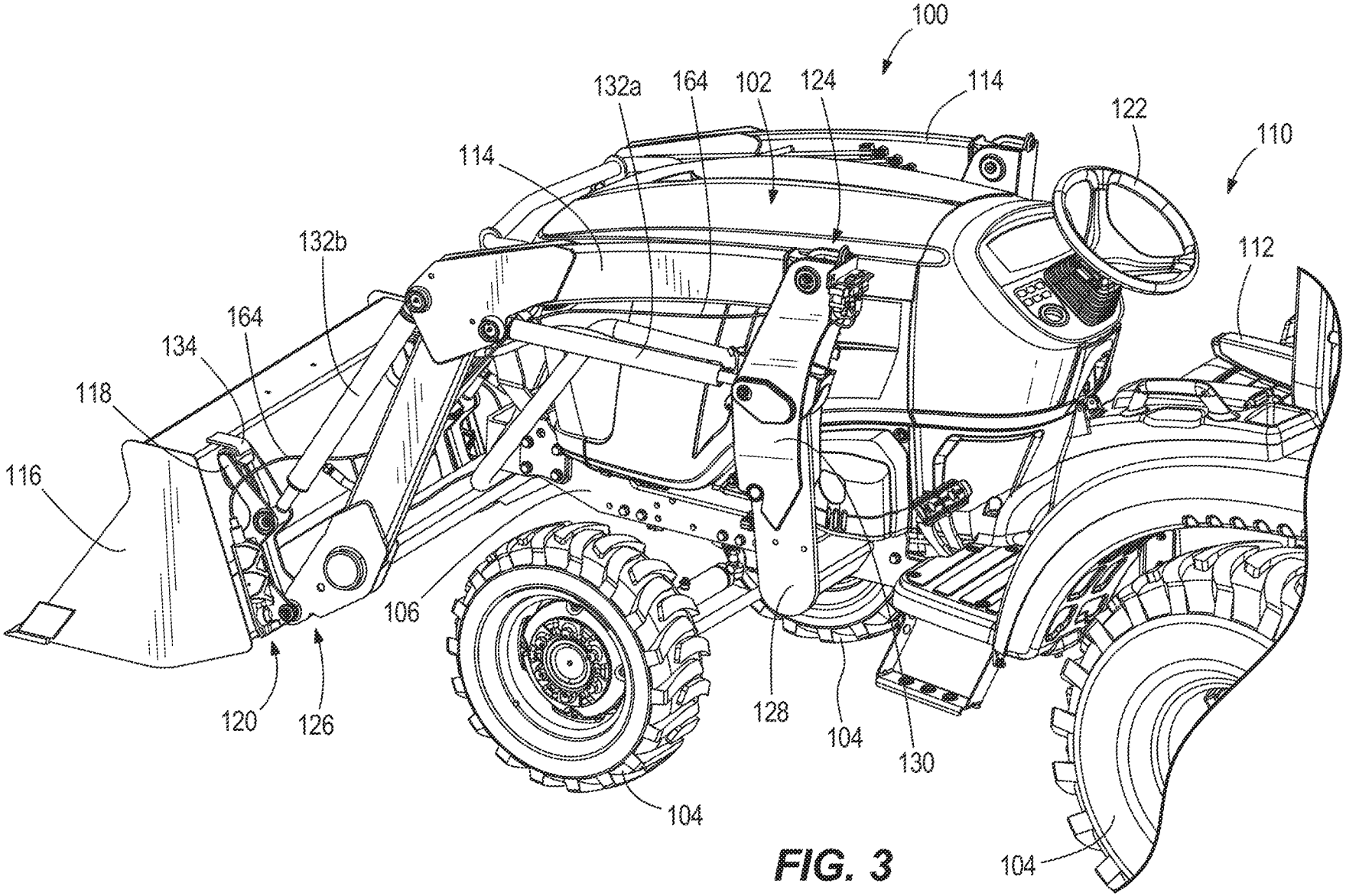
FIG. 3 is a partial rear perspective view of the work vehicle, implement, and connection system of FIG. 1.

FIGS. 1-3 illustrate an embodiment of a work vehicle 100. The work vehicle 100 is shown as a tractor but may be, for example, a front end loader, a 4WD loader, a skid steer, a riding lawn mower, a backhoe, or other work vehicle. A prime mover 102 supplies torque through a transmission (not shown) to at least one of a plurality of wheels 104 to move the work vehicle 100. Two of the wheels 104 may be powered by the prime mover 102 or all four wheels 104 may be powered by the prime mover 102. In further embodiments, the wheels 104 may be replaced or modified with a continuous track. The prime mover 102 may include any rotational driveline power supply, for example, an internal combustion engine, a hydraulic motor, a hydrostatic system, an electric motor, and the like.

The work vehicle 100 further includes a frame 106, an electrical power source 108, and an operator control area 110 associated with a lift system 113 and a connection system 120 of the vehicle 100. The power source 108 (e.g., a battery) is coupled to the frame 106 in a position under a seat 112, for example.

The operator control area 110 provides operator control of the work vehicle 100 and includes a steering wheel 122 and a plurality of controls. In other embodiments, the steering wheel 122 may be replaced by a plurality of levers to control the direction of movement of the work vehicle 100 through the prime mover 102 and/or the transmission. The controls are also coupled to other components on the work vehicle 100, e.g., a hydraulic system, an auxiliary drive shaft, etc., and may be in the form of electrical switches, mechanical actuators, or a combination thereof.

Referring also to FIGS. 2 and 3, each side of the lift system 113 includes a movable arm 114 (e.g., a loader boom), a coupler (such as an attachment bracket) 118, a fixed member 128, a detachable member 130, and hydraulic cylinder assemblies 132*a*, 132*b*. The fixed member 128 is attached at a first end 129*a* to the frame 106 on a side of the work vehicle 100 proximal to the operator control area 110. The fixed member 128 is also coupled at an opposite end 129*b* to a first end 131*a* of the detachable member 130, which is coupled at its opposite end 131*b* to a proximal end 124 of the arm 114. In the illustrated embodiment, the fixed member 128 and the detachable member 130 are located between the wheels 104 (e.g., front and back wheels) and adjacent the operator control area 110. In other embodiments, the fixed member 128 and the detachable member 130 may be one integral member fixedly secured to the work vehicle 100.

The proximal end 124 of the arm 114 is coupled to the frame 106 and a distal end 126 of the arm 114 is attached to the coupler 118, which is selectively couplable to an implement 116, as will be further described herein. The cylinder assembly 132*a* extends between the arm 114 and the detachable member 130. In some embodiments, the arm 114 may be a single integral component extending across the work vehicle 100.

The lift system 113 serves to manipulate the implement 116, described and illustrated herein as a bucket. In other embodiments, however, the implement 116 may be a sweep cleaner, hay bale fork, hay bale hugger, grapple, scraper, pallet fork, debris blower, blade, snow pusher, or the like for performing a specific task.

The implement 116 is attached and secured to the lift system 113 through a connection assembly or system 120. The coupler 118 may be considered alternatively as part of the lift system 113 or as part of the connection system 120 such that the connection system 120 can include collectively the coupler 118, a hook 134 affixed to the implement 116, and a protrusion 136 extending from a surface of the implement 116 with an aperture 138 therethrough. The implement 116 may include only one protrusion 136 or, in other embodiments, a protrusion 136 is positioned on each side of the implement 116.

Figure 4:
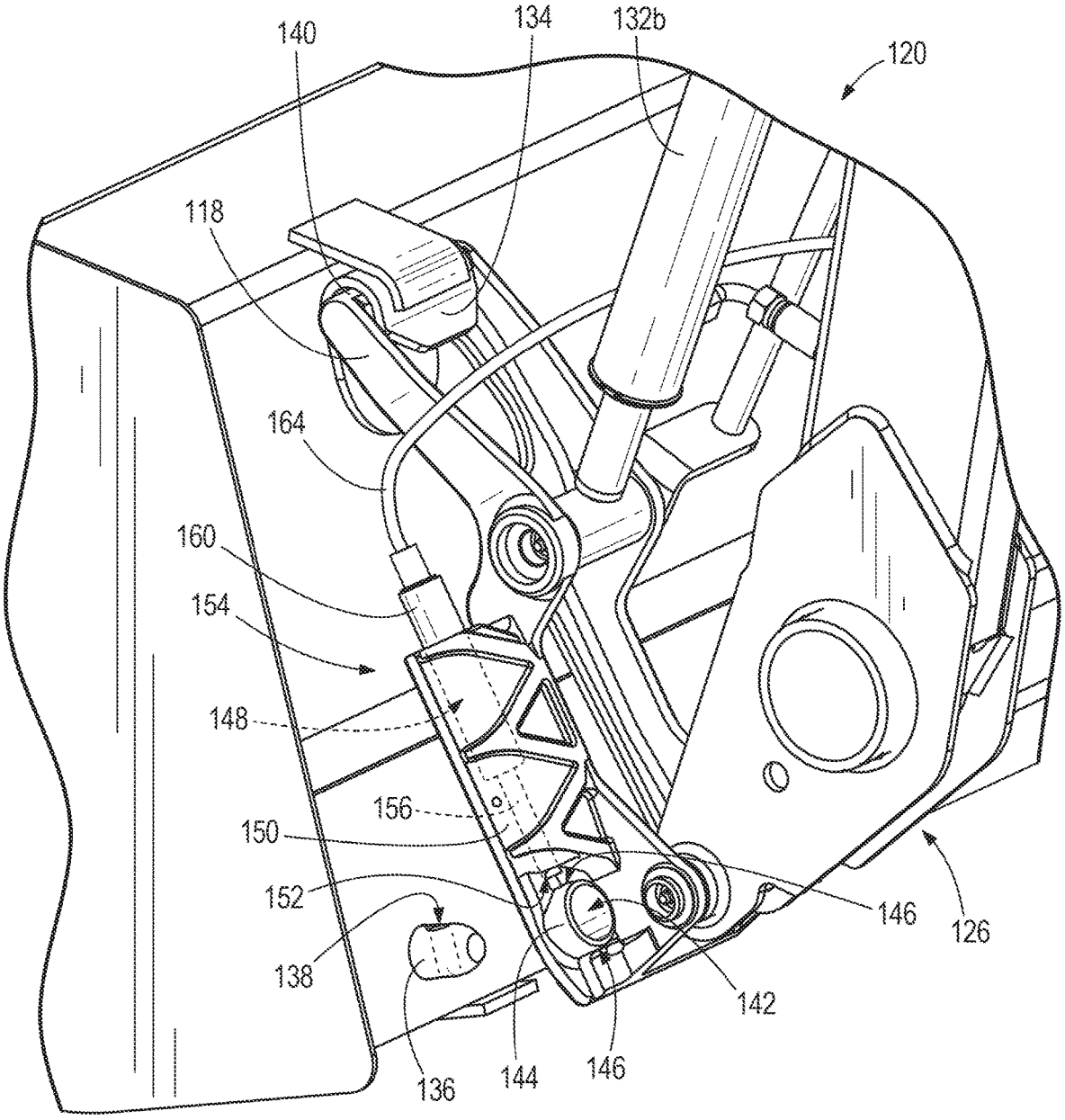
FIG. 4 is a detailed perspective view of a movable arm, a coupler, the connection system, and the implement of FIG. 1 illustrating the coupler partially engaged with the implement.

The coupler 118 is pivotable relative to the arm 114 by actuation of the hydraulic cylinder assembly 132*b*. The coupler 118 includes a bar 140 for engagement with the hook 134 of the implement 116. The bar 140 is a first attachment point of the connection system 120. As shown in FIG. 4, a hole 142 defined in a portion of the coupler 118 is sized to receive the protrusion 136 of the implement 116. In the illustrated embodiment, a cylindrical projection 144 surrounds and further defines the hole 142 and is a second attachment point of the connection system 120. The cylindrical projection 144 includes two diametrically opposed transverse openings 146. A sleeve 150 of the coupler 118, positioned proximate the projection 144, defines therein a cylindrical elongated passage 148 generally aligned with the openings 146. In other embodiments, different structural features may serve as first and second attachment points.

Figure 5:
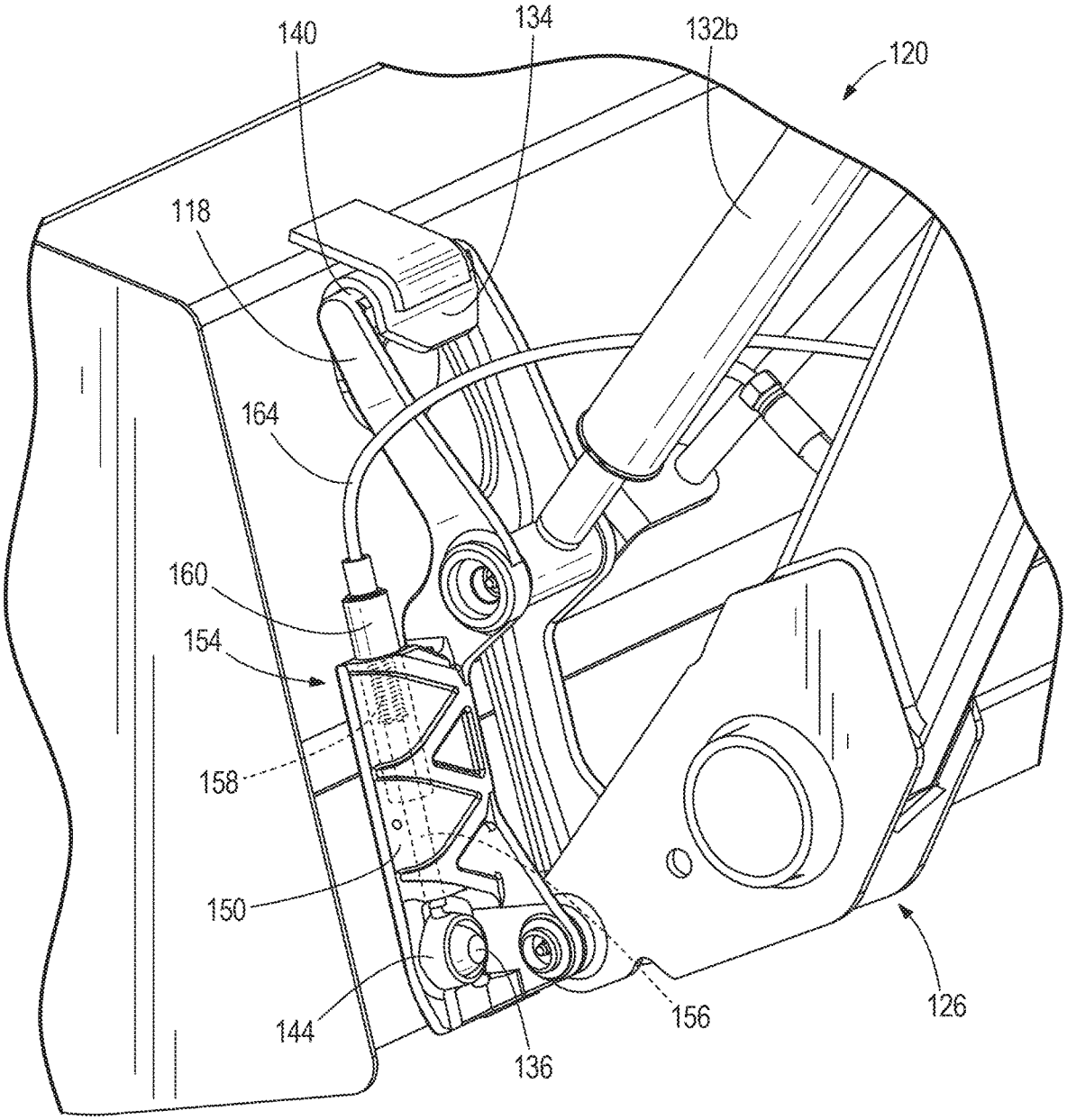
FIG. 5 is a detailed perspective view of a portion of FIG. 3 illustrating the coupler fully engaged with the implement and the lock assembly disengaged from a portion of the implement.
Figure 6:
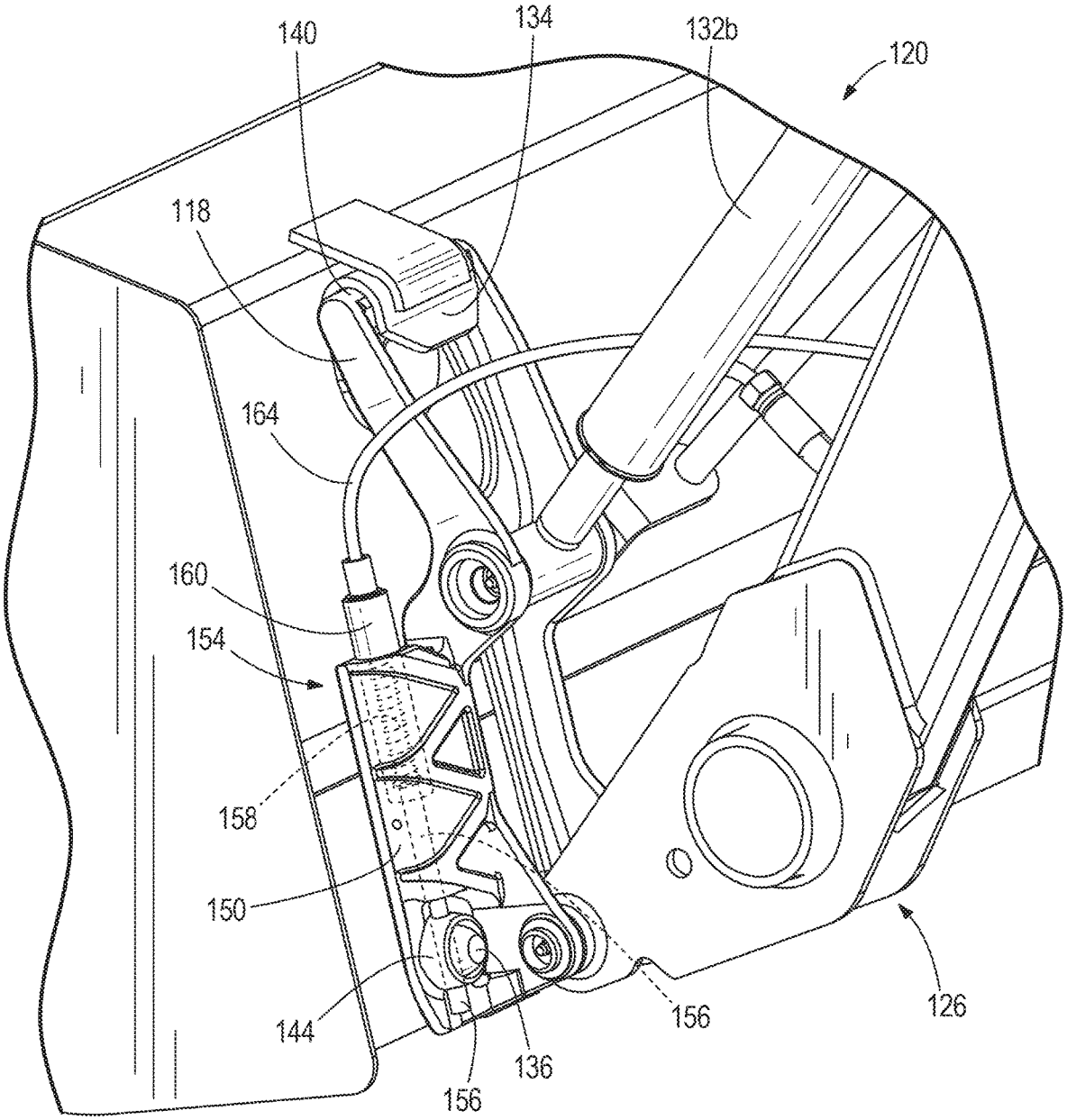
FIG. 6 is a detailed perspective view of the portion of FIG. 3 with the lock assembly engaged with the portion of the implement.

With continued reference to FIG. 4, a lock assembly 154 of the connection system 120 is operationally disposed in the elongated passage 148. The lock assembly 154 includes a locking pin 156 operable to move between an extended position and a retracted position. Referring also to FIGS. 5 and 6, a resilient member (e.g., a spring) 158 is positioned such that the locking pin 156 is biased toward the extended position. The resilient member 158 and the locking pin 156 are configured in a concentric relationship.

In the illustrated embodiment, the lock assembly 154 moves via an electrically operated actuator 160. The actuator 160 may be any suitable electrical actuator that activates when supplied with power including, but not limited to, an electric motor, a solenoid, and the like. In other embodiments, the actuator 160 may be driven by another power source. The actuator 160 has an outer surface that is at least partially surrounded by the sleeve 150 of the coupler 118. In the illustrated embodiment, a majority of the outer surface of the actuator 160 is surrounded by the sleeve 150 of the coupler 118. In such embodiments, the sleeve 150 may protect the actuator 160 and/or the locking pin 156 from impact damage, jamming due to introduction of contaminants such as dirt, and the like.

The actuator 160 is coupled to the locking pin 156 and translates the locking pin 156 between the extended position and the retracted position. Stated another way, the actuator 160 activates to linearly move or shift the locking pin 156 toward at least one of the extended position and the retracted position. In the illustrated embodiment, a button or other interface in the control area 110 is configured to actuate the actuator 160 to move the locking pin 156. In embodiments having the resilient member 158, the actuator 160 moves the locking pin 156 toward the retracted position against the bias of the resilient member 158.

With reference to FIGS. 5 and 6, in operation, an existing implement (such as an illustrated bucket) 116 can be disconnected from the coupler 118 on the work vehicle 100. To do so, the work vehicle operator positions the existing implement 116 on the ground. The work vehicle operator then moves the locking pin 156 of the lock assembly 154 to the retracted position by actuating the actuator 160. In the retracted position, the locking pin 156 is clear of the openings 146 of the coupler 118 (FIG. 5).

Once the locking pin 156 of the lock assembly 154 is retracted, the work vehicle operator then manipulates the coupler 118 relative to the arm 114 via actuation of the hydraulic cylinder assemblies 132*a*, 132*b* to pivot the coupler 118 relative to the implement 116. In the illustrated embodiments, the coupler 118 pivots relative to the implement 116 about the connection of the bar 140 of the coupler 118 to the corresponding hook 134 of the implement 116. This pivot motion moves the coupler 118 away from the implement 116 such that the protrusion 136 is no longer received in the hole 142. Thereafter, the work vehicle operator moves the arm 114 toward the ground surface to detach the bar 140 from the hook 134 such that the implement 116 is not attached at the first attachment point and is free of the vehicle 100.

To attach another implement (such as another bucket, a hay bale fork, a snow pusher, etc.) 116, the work vehicle operator aligns the bar 140 of the coupler 118 with the hook 134 of the (new) implement 116 by manipulating the arm 114 relative to the frame 106 and rotating the coupler 118 relative to the arm 114. Once the bar 140 of the coupler 118 engages the corresponding hook 134 of the implement 116 at the first attachment point, the coupler 118 is rotated relative to the implement 116 about the connection between the bar 140 and the hook 134. The work vehicle operator manipulates the hydraulic cylinder assemblies 132*a*, 132*b* until the protrusion 136 of the implement 116 enters and is fully received in the corresponding hole 142 of the coupler 118. When the protrusion 136 is fully received in the hole 142, the cylindrical projection 144 laterally surrounds the protrusion 136 and the aperture 138 of the protrusion 136 aligns with the two openings 146 of the cylindrical projection 144. In this position, the implement 116 is attached to the coupler 118 at the first attachment point.

Next, the lock assembly 154 is operated to securely couple the implement 116 to the coupler 118. The vehicle operator activates the actuator 160 to release the locking pin 156, permitting the resilient member 158 to move the locking pin 156 to the extended position. In this position, the locking pin 156 extends through the openings 146 of the cylindrical projection 144 (FIG. 6). The implement 116 is therefore securely coupled to the coupler 118 at the second attachment point.

Although only one arm 114, coupler 118, hook 134, protrusion 136, and lock assembly 154 has been described above in the operation of the connection system 120, the present disclosure contemplates embodiments of a work vehicle 100 with two arms 114, couplers 118, hooks 134, protrusions 136, and lock assemblies 154. In such embodiments, the two lock assemblies 154 operate in the same manner concurrently during the operations discussed herein.

Figure 7:
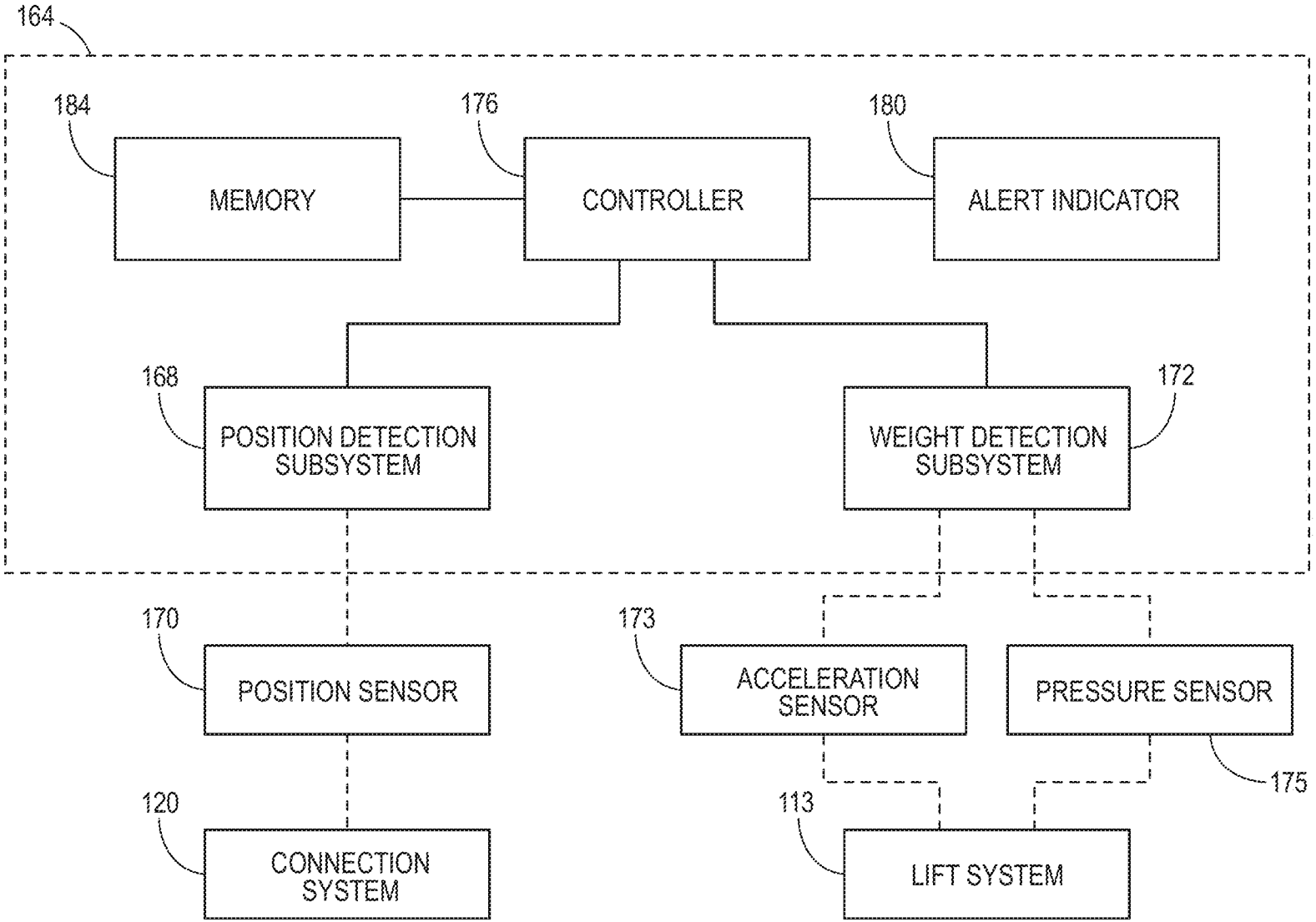
FIG. 7 is a schematic diagram of a monitoring system for the connection system of FIG. 1.

Referring now to FIG. 7, the work vehicle 100 further includes a monitoring system 164. The monitoring system 164 includes a position detection subsystem 168, a weight detection subsystem 172, a controller 176, an alert indicator 180, and memory 184. In the illustrated embodiment, the memory 184 is an external unit separate from the controller 176, but in other embodiments, the memory 184 may be integral with the controller 176.

The position detection subsystem 168 is operably coupled to the connection system 120 and is configured to continuously determine the position of the locking pin 156, either retracted or extended, in real time. In some embodiments, the position detection subsystem 168 may be an electrical or magnetic sensor that monitors a position of the locking pin 156 relative to the actuator 160, monitors the biasing force of the resilient member 158 (e.g., via a pressure switch), monitors a position of the locking pin 156 relative to the far opening 146 (the opening 146 farthest from the sleeve 150) in the cylindrical projection 144, and the like to determine the position of the locking pin 156. Alternatively, the position detection subsystem 168 can monitor relative contact between the locking pin 156 and the protrusion 136 of the implement 116 to complete an electrical circuit once the locking pin 156 is received within the aperture 138 or break the electrical circuit once the locking pin 156 is displaced from the aperture 138. The subsystem 168 therefore provides data or signals from a form of a position sensor 170 representative of the state (retracted or extended) of the locking pin 156. In other embodiments, the position detection subsystem 168 may simply monitor the control area 110 to determine the intended position of the locking pin 156. For example, the position detection device 168 may recognize when a button or other interface in the control area 110 is used to actuate the actuator 160 to move the locking pin 156 from the extended position to the retracted position, or vice versa. The position subsystem 168 can thereby determine the intended position of the locking pin 156. In yet other embodiments, a locally sensed position (extension or retraction) of the locking pin 156 may be monitored.

The weight detection subsystem 172 is operably coupled to the lift system 113 and is configured to determine the weight supported by the lift system 113. In some embodiments, aspects of the weight detection subsystem 172 include one or more acceleration sensors 173, such as 3-axis gyroscopes, which may be arranged on the various components of the lift system 113, e.g., the arm 114, the fixed member 128, or the detachable member 130. Pressure sensors 175 may also be provided for the hydraulic cylinder assemblies 132*a*, 132*b* as part of this system to sense hydraulic pressure. Such acceleration sensors 173 and pressure sensors 175 continuously collect acceleration data regarding the components of the lift system 113 and fluid pressure data regarding the hydraulic assemblies 132*a*, 132*b*, sending the collected data or signals to the controller 176. The controller 176 uses the data to calculate the weight supported (or changes in weight supported) by the lift system 113 in real time, e.g., using an open kinematic chain to determine forces and torques to arrive at a change in mass. The weighing system of European Publication No. 2843378 (EP 2843378), filed Feb. 2, 2014, to Peters et al., herein incorporated by reference in its entirety (limited such that no subject matter is incorporated that is contrary to or irreconcilably inconsistent with the explicit disclosure herein), is one such example of a weight detection subsystem 172 that may be utilized as part of the monitoring system 164. The memory 184 stores the position data and the weight data received by the controller 176 so that position and weight data gathered in real time may be compared against previously received position and weight data.

Specifically regarding interpretation of the weight data, the controller 176 is programmed to identify the weight value attributable to the lift system 113 alone and is also programmed to identify the weight values for various attachable implements 116, which are stored in memory 184. The weights of the lift system 113, with and without an implement 116, therefore serve as baselines for comparison to weight data received from the weight detection subsystem 172 during the course of attaching and detaching a particular implement 116. As an example, the controller 176 can identify weight data received as representing a 'first state' weight in which all or a portion of an implement 116 is supported by the lift system 113 and can identify weight data received as representing a 'second state' in which no implement 116 is supported by the lift system 113. A 'portion' of an implement 116 may include values representing an increase in detected weight of greater than 2% of the stored weight value of the implement, greater than 5% of the stored weight value of the implement, greater than 10% of the stored weight value of the implement, greater than 20% of the stored weight value of the implement 116, etc., such percentages being programmable into the controller 176. In other words, a significant enough portion of the weight of the implement is supported or not supported by the lift system 113 during the process of attaching and detaching an implement 116 that the controller 176 can determine a change from the first state to the second state and vice versa. In other embodiments, since actual weights (magnitude) may be stored in the controller 176 based on the weight of the lift system 113 without an implement 116 and with one of a number of implements 116 configured for operation with the vehicle 100, the controller 176 may determine a change from the first state to the second state and vice versa based on absolute weight values or portions thereof.

In some embodiments, the position detection subsystem 168 and the weight detection subsystem 172 include the relative sensors, circuits, etc. without the controller 176. In some embodiments, the controller 176 can be considered to be part of the position detection subsystem 168 and/or part of the weight detection subsystem 172.

The controller 176 is further configured to output condition data to the alert indicator 180, which in turn is configured to provide an indication to the work vehicle operator in the form of an audible alarm, as will be further described herein. In other embodiments, the alert indicator 180 may be electrically coupled to an indicator member (e.g., LED display) located within the operator control area 110 or otherwise provide the work vehicle operator a visual indication.

Figure 8:
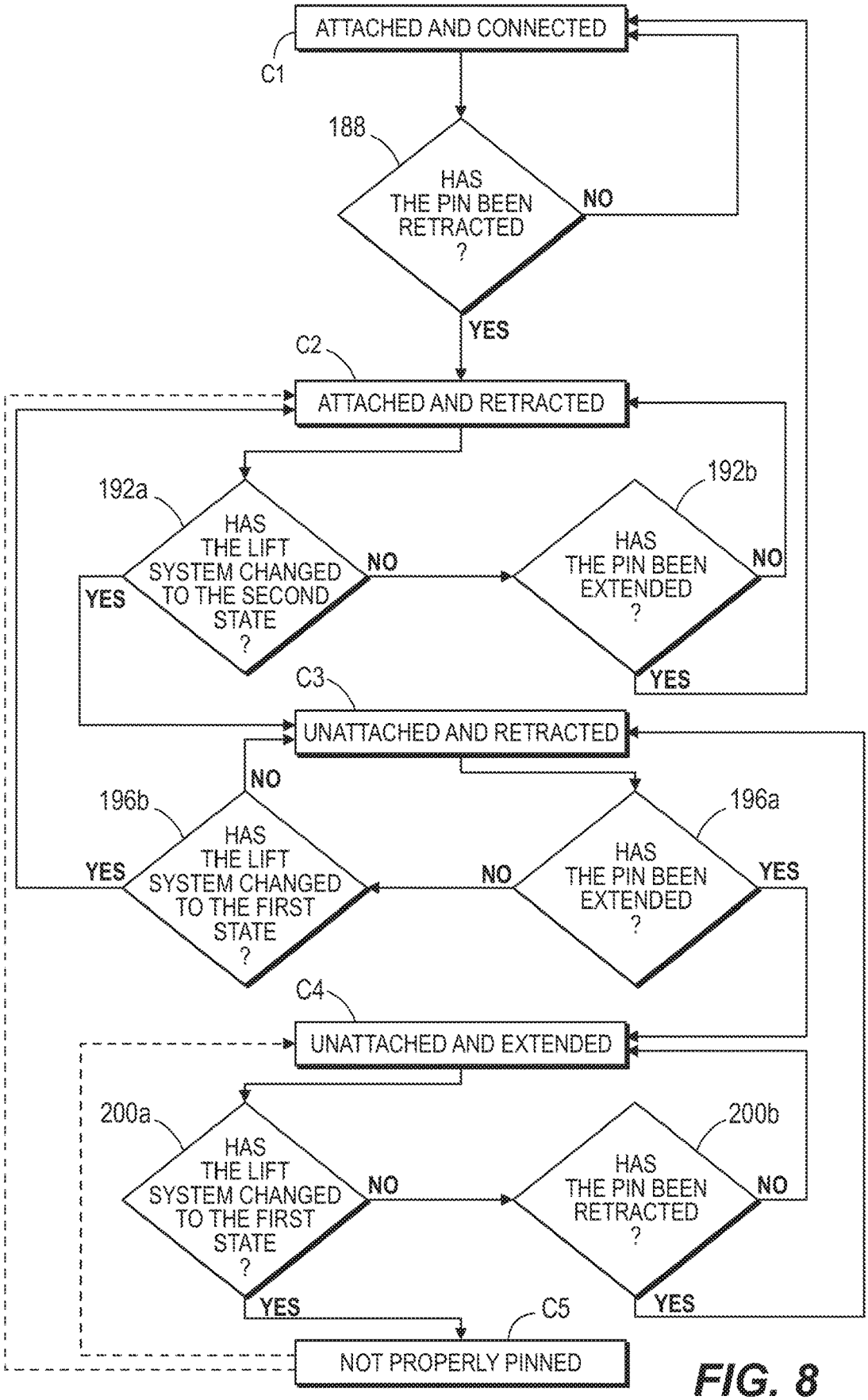
FIG. 8 is a flow diagram illustrating conditional states for indicating whether the implement of FIG. 1 is securely coupled to the coupler.

FIG. 8 illustrates a method and conditional states for identifying whether an implement 116 is properly secured to the coupler 118.

In operation, and as one example, a work vehicle operator may wish to exchange a first implement 116 in use with the work vehicle 100 for a second implement 116. In this case, the first implement 116 is attached to the coupler 118 at the first attachment point and is secured to the coupler 118 at the second attachment point, as previously described. When the lift system 113 is in this first state and the locking pin 156 is extended, the connection system 120 is in the 'attached and connected' configuration C1. This represents standard operation of the vehicle 100 with an implement 116.

Specifically, when the work vehicle 100 is in use, the controller 176 (or its processor) continuously performs an iterative algorithm. The controller 176 receives data/signals from the weight detection subsystem 172 and from the position detection subsystem 168 to determine a configuration of the connection system 120. If the controller 176 determines that the lift system 113 is in the first state (through the weight detection subsystem 172) and that the locking pin 156 is extended (through the position detection subsystem 168), the controller 176 identifies that the connection system 120 is in the 'attached and connected' configuration C1 and thereafter proceeds to step 188. During step 188, the controller 176 monitors the position of the locking pin 156.

As described herein, to begin exchanging the first implement 116 for the second implement 116, the work vehicle operator will actuate the actuator 160 to move the locking pin 156 into the retracted position. Although the locking pin 156 has been moved from the extended position to the retracted position, the lift system 113 still supports all or a portion of the implement 116 and remains in the first state. The connection system 120 is therefore in the 'attached and retracted' configuration C2.

In the configuration C2, the controller 176 continuously receives data/signals from the position detection subsystem 168 and the weight detection subsystem 172. If the controller 176 determines through the weight detection subsystem 172 that the lift system 113 has changed from the first state to the second state (i.e., the operator has or is in the process of detaching the coupler 118 from the implement 116 as described), step 192*a*, the connection system 120 is identified as in the 'unattached and retracted' configuration C3. If the locking pin 156 is instead extended while the lift system 113 is in the first state, step 192*b*, the connection system 120 simply returns to the configuration C1.

In the configuration C3, the controller 176 again continuously receives data/signals from the position detection subsystem 168 and the weight detection subsystem 172. If the locking pin 156 is extended while the lift system 113 is in the second state, step 196*a* (i.e., the operator has extended the pin 156 with no additional implement 116 attached or in the process of being attached), the connection system 120 is identified as in the 'unattached and extended' configuration C4. If the controller 176 instead determines through the weight detection subsystem 172 that the lift system 113 has changed from the second state to the first state (i.e., the operator has or is in the process of attaching the coupler 118 to an implement 116 as described), step 196*b*, the connection system 120 returns to configuration C2.

In the configuration C4, the controller 176 again continuously receives data/signals from the position detection subsystem 168 and the weight detection subsystem 172. If the controller 176 determines through the weight detection subsystem 172 that the lift system 113 has changed from the second state to the first state, step 200*a*, the connection system 120 is identified as in the 'not properly pinned' configuration C5. If the locking pin 156 is instead retracted while the lift system 113 is in the second state, step 200*b*, the connection system 120 returns to the configuration C3.

When the controller 176 determines that the connection system 120 is in the 'not properly pinned' configuration C5, the controller 176 outputs an alert condition signal to the alert indicator 180. The alert indicator 180 then provides an indication to the work vehicle operator. The operator can then take appropriate measures to return the connection system to any of configurations C1-C4. For example, the operator can move the locking pin 156 to the retracted position to bring the connection system 120 back into the attached and retracted position C2. Alternatively, the operator can operate the arm 114 to detach the coupler 118 from the implement 116 to bring the connection system 120 into the back into the unattached and extended configuration C4.

Although the given example begins with the controller 176 identifying the connection system 120 in the 'attached and connected' configuration C1, the controller 176 may enter the algorithm when the connection system 120 is in any of the configurations C1-C4. For instance, rather than a work vehicle operator wishing to exchange a first implement 116 for a second implement 116, a work vehicle operator may bring the work vehicle 100 out of storage, in which case the work vehicle 100 may not have an implement 116 securely coupled or attached to the coupler 118. In this instance, with the locking pin 156 in the retracted position, the connection system 120 is in the 'unattached and retracted' configuration C3. The controller 176 will proceed within each configuration as described herein.

Various features and advantages are set forth in the following claims.

The invention claimed is:

1. A work vehicle comprising:

a frame;

a lift system including a movable arm secured to the frame;

a coupler connected to the movable arm, operable via a hydraulic cylinder, and attachable to a work implement, the coupler movable relative to the movable arm to couple a work implement at first and second attachment points, the coupler including a pin member receivable within the work implement to form the second attachment point, the coupler changed from a first state to a second state if the pin member has translated from a retracted position to an extended position;

a first sensor operatively coupled to a portion of the lift system and configured to send a signal representative of a change in pressure of hydraulic fluid associated with the movable arm;

a second sensor operatively coupled to the coupler and configured to send a signal representative of a change in state of the coupler; and a monitoring system including a controller configured to receive signals from the first sensor and from the second sensor, determine whether the lift system has changed from a state in which no work implement is supported thereby to a state in which all or a portion of a work implement is supported thereby, determine whether the lift system has changed from a state in which all or a portion of a work implement is supported thereby to a state in which no work implement is supported thereby, and output a signal to an operator of the work vehicle if 1) the coupler has changed from the first state to the second state and 2) the lift system has changed from a state in which no work implement is supported thereby to a state in which all or a portion of a work implement is supported thereby.

2. The work vehicle of claim 1, further including an acceleration sensor operatively coupled to a portion of the lift system, and wherein the controller is configured to receive a signal from the acceleration sensor.

3. The work vehicle of claim 1, wherein a work implement includes a work implement in the form of one of a bucket, a fork, a broom, or a blade.

4. A monitoring system for a work vehicle, the work vehicle having a lift system to which an implement is attachable via a connection assembly, the lift system including a movable arm affixed to a frame of the work vehicle and at least one hydraulic cylinder operable to move a portion of the movable arm relative to the frame, the connection assembly including a coupler secured to the movable arm and movable relative thereto to couple the implement at first and second attachment points, the coupler including a pin member receivable within a portion of the implement to form the second attachment point, the monitoring system comprising:

a weight detection subsystem operable with the lift system, the weight detection subsystem configured to transfer signals representative of a weight supported by the lift system;

a position detection subsystem operable with the connection assembly, the position detection subsystem configured to transfer signals representative of a state of the connection assembly; and a controller in operable communication with the weight detection subsystem and the position detection subsystem, the controller configured to receive signals from the weight detection subsystem and from the position detection subsystem, determine a condition of the connection assembly based on the signals received to determine if the pin member is in an extended state or if the pin member is in a retracted state, and output a signal based at least in part on the determined condition.

5. The monitoring system of claim 4, wherein the weight detection subsystem includes a pressure sensor associated with the at least one hydraulic cylinder.

6. The monitoring system of claim 4, wherein the controller configured to determine a condition of the connection assembly based on the signals received includes the controller configured to determine if a weight of an implement is supported by the lift system.

7. The monitoring system of claim 4, wherein the controller is configured to determine a condition of the connection assembly identified as the detachment of an implement based on a signal received from the weight detection subsystem representative of a change in weight that is less than a stored weight value for the implement.

8. The monitoring system of claim 4, wherein the implement is one of a bucket, a fork, a blade, or a broom.

9. The monitoring system of claim 4, wherein the controller configured to output a signal based at least in part on the determined condition means the controller configured to output a signal in response to the pin member in an extended state and a determination by the controller that the lift system has changed from a state in which no implement is supported thereby to a state in which all or a portion of an implement is supported thereby.

10. A non-transitory computer readable medium comprising program instructions for permitting a controller to monitor a work vehicle through stages of attachment of a work implement thereto, the work vehicle including a lift system to which an implement is attachable via a connection assembly, the program instructions when executed causing a processor of the controller to:

receive signals from a weight detection subsystem operable with the lift system, the signals representative of a weight supported by the lift system;

receive signals from a position detection subsystem operable with the connection assembly, the signals representative of a state of the connection assembly;

determine a condition of the connection assembly based on the signals received to determine if a pin member of the connection assembly is in an extended state or in a retracted state;

determine whether the lift system has changed from a state in which no work implement is supported thereby to a state in which all or a portion of a work implement is supported thereby;

determine whether the lift system has changed from a state in which all or a portion of a work implement is supported thereby to a state in which no work implement is supported thereby; and output a signal based at least in part on two or more of the determinations.

11. The monitoring system of claim 10, wherein to output a signal based at least in part on two or more of the determinations means to output a signal in response to the pin member in an extended state and a determination that the lift system has changed from a state in which no work implement is supported thereby to a state in which all or a portion of a work implement is supported thereby.

* * * * *